US005815858A

United States Patent [19]

Dodge

[11] Patent Number: 5,815,858

[45] Date of Patent: Oct. 6, 1998

[54] SLOT AND POST FRONT OPERATING FUTON

[75] Inventor: Peter W. Dodge, Birchwood, Wis.

[73] Assignee: Cross Island Trading Co., Inc., White Plains, N.Y.

[21] Appl. No.: 716,650

[22] Filed: Sep. 16, 1996

[51] Int. Cl.[6] ..... A47C 17/17; A47C 17/04

[52] U.S. Cl. ..... 5/37.1; 5/47

[58] Field of Search ..... 5/37.1, 41, 47

[56] References Cited

U.S. PATENT DOCUMENTS

| | | | |
|---|---|---|---|
| 4,829,611 | 5/1989 | Fireman et al. | 5/37.1 |
| 4,875,244 | 10/1989 | Tremblay | 5/37.1 |
| 5,146,640 | 9/1992 | Barton et al. | 5/37.1 |
| 5,153,952 | 10/1992 | Barton et al. | 5/37.1 |
| 5,303,432 | 4/1994 | Fitts | 5/47 |
| 5,664,268 | 9/1997 | Stoler et al. | 5/37.1 |

*Primary Examiner*—Alexander Grosz
*Attorney, Agent, or Firm*—Nixon & Vanderhye

[57] ABSTRACT

The futon includes a back deck guided for movement between horizontal and forwardly-inclined positions by rollers engaging in slots of the side frames of the futon. The seat deck is pivotally secured to the forward end of side extensions of the back deck by inter-engaging slots and pins. To convert from a bed position, the seat deck is initially pulled forwardly to locate the rollers in positions in the guide slots for movement of the back deck from the horizontal position to the inclined position. By pivoting the seat deck upwardly and permitting it to slide downwardly relative to the pins, the seat deck is positioned to leverage the back deck into the inclined position upon pivoting the seat deck back towards its horizontal position. The back deck is thus inclined and locked in the inclined position by the engagement of the rollers in extreme ends of guide slots. The seat deck rests on a futon cross piece and is supported along its rear edge by the slot and pin connection with the back deck.

2 Claims, 4 Drawing Sheets

SLOT AND POST FRONT OPERATING FUTON

BACKGROUND AND SUMMARY OF THE INVENTION

1. Field of the Invention

The present invention relates to a futon, i.e., a furniture piece convertible between a sofa and a bed, and particularly relates to a futon having a slot and post front operating system for facilitating conversion between sofa and bed positions.

2. Background of the Invention

Many different designs for futons have been proposed and constructed in the past. Generally speaking, it has been and remains important to provide for the conversion of the futon between sofa and bed positions from the front of the futon. Preferably, an individual may stand in front of the futon and operate the system to effect the conversion without the necessity of stepping to one side or behind the futon. One such system employs what is known in the industry as a kicker assembly to facilitate the conversion and provide leverage to raise the back deck into an inclined position forming a seat back and subsequently to lower the back deck into a bed position. In that arrangement as well as in most other arrangements, the futon includes a seat deck and a back deck pivotally secured to one another at interior ends. The back deck typically has rollers engaging in slots on each of the side frames of the futon enabling the back deck for movement between horizontal and inclined rearward positions during conversion. In most cases, front and rear cross supports interconnect the side frames and provide support for both the seat deck and back deck in a bed position and at least one of the seat deck and back deck in a sofa position. These kicker assemblies, however, are typically pawls formed of wood and pivotally secured to the seat deck for engagement in a slot or recess on the back deck when the seat deck is raised from the bed position. The pawl engages in the slot and the seat deck is then displaced downwardly to move the back deck as guided by the rollers engaging in the slots into an inclined position forming the sofa. The pawls of the kicker assembly, however, have frequently broken down in use requiring replacement and have not proven particularly satisfactory for their intended use.

Another type of futon employs a slot and post system which avoids the use of kicker assemblies and provides for the conversion by a sliding and pivoting action of the seat deck relative to the back deck to leverage the back deck from its horizontal bed position to an inclined sofa position and return. In that system, pins are provided on side frame extensions of the back deck and engage in elongated slots in the side frame members of the seat deck, the slots extending generally parallel to the seat deck. By inclining the seat deck from the horizontal bed position to an inclined position, the seat deck can be displaced so that the pins are located at the opposite ends of the slots. This provides leverage to pivot the seat deck in the opposite direction causing the back deck to move to an inclined position guided by the engagement of its rollers in slots in the side frames of the futon. While this has proven satisfactory in operation, the leverage afforded by the arrangement of the slot and posts between the seat deck and back deck has been insufficient and requires a substantial force to be applied to the seat deck when leveraging the back deck into the inclined position. Additionally, continued use of this system over time puts substantial stress on the seat deck side frame members which can result in their fracture.

In accordance with the present invention, there is provided a novel and improved slot and post front operating futon comprising a pair of side frames spaced from one another with front and rear cross supports, a seat deck and a back deck between the side frames and adjacent respective forward and rear portions of the futon. Each of the side frames has a first guide slot adjacent the rear portion of the futon forming generally vertically and horizontally extending guide portions, respectively, and a second slot forwardly of the rear portion having a generally horizontally extending guide portion and a guide portion extending therefrom in a downwardly inclined rearward direction. The back deck has side frame members with rollers along each of the opposite sides thereof engaging in the first and second slots respectively enabling movement of the back deck between a first generally horizontal position and a second inclined position. The back deck includes forward extensions of the side frame members having pins directed toward one another, and a cross piece extending between the side frame members of the back deck and rearwardly of the pins. The seat deck has a pair of side frame members with rear portions thereof extending between the forward extensions of the back deck side frame members and slots along the seat deck side frame members for receiving the pins, the slots having first rear slot portions extending generally parallel to the seat deck side frame members and terminating in front slot portions at ends thereof closest to the front seat deck portion, the front slot portions being offset to one side of the side frame members. The seat deck and the back deck are movable between a first position with the back deck and seat deck lying generally horizontally in a common plane resting on the front and rear supports, respectively, and a second position with the back deck inclined upwardly and rearwardly forming a seat back and the seat deck inclined upwardly and forwardly from the seat back forming a seat. The seat deck and back deck are convertible between the positions by pivoting the seat deck in one direction about the pins to an upwardly-inclined position displacing the seat deck relative to the pins to locate the pins in the offset slot portions thereof, thereby locating ends of the seat deck side frame members below the cross piece to enable the back deck to be moved into the inclined position forming the seat back by pivoting the seat deck in a direction opposite the one direction with the side frame seat deck members leveraging the seat back into the inclined position.

Accordingly, it is a primary object of the present invention to provide a novel and improved slot and post front operating system for a futon affording improved leverage between the seat deck and back deck for conversion between bed and sofa positions as well as security against fracture of the side frame members forming the seat and back decks.

DETAILED DESCRIPTION OF THE DRAWINGS

Figure 1:
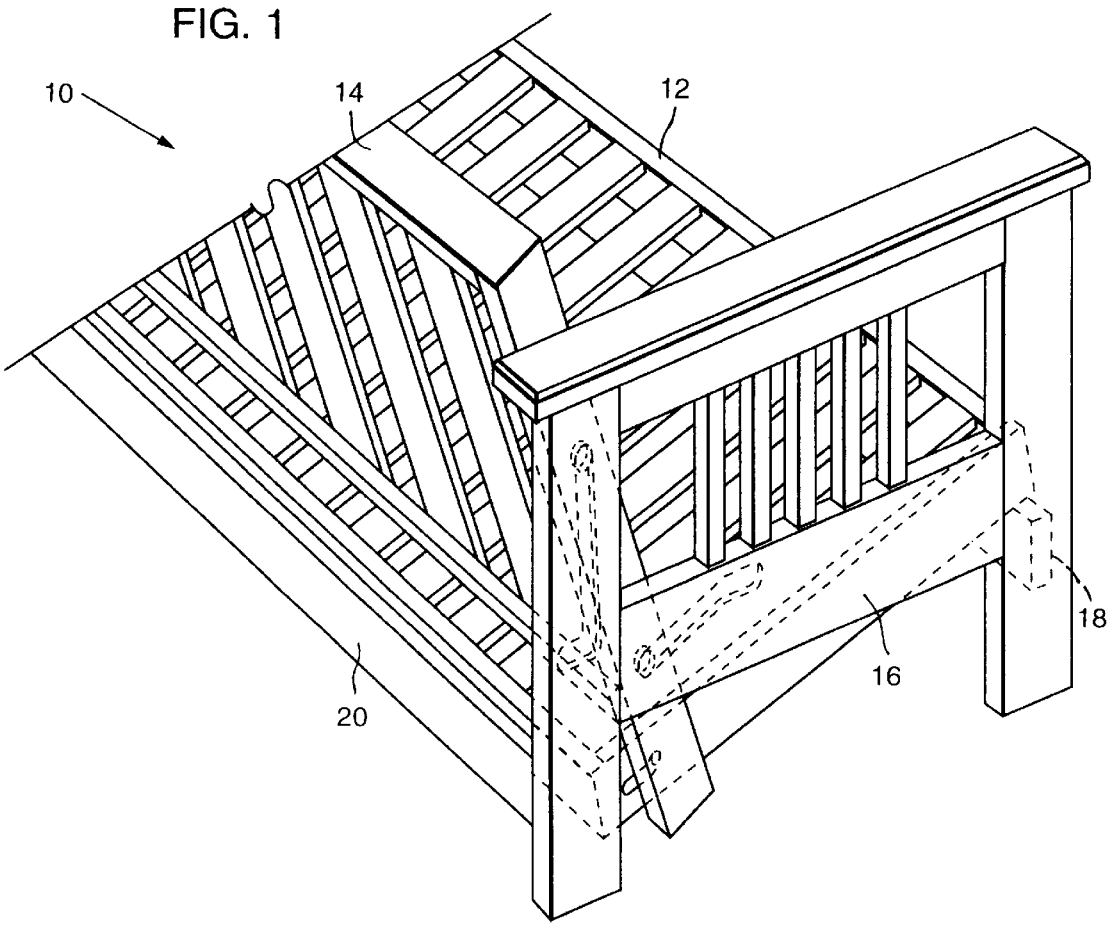
FIG. 1 is a fragmentary perspective view of a futon constructed according to the present invention.

Referring now to FIG. 1, there is illustrated a futon generally designated 10 constructed in accordance with the present invention. Futon 10 includes a seat deck 12 and a back deck 14 disposed between side frame members 16, the seat deck 12 and back deck 14 being movable between the sofa position illustrated in FIG. 1 and a bed position illustrated by the full lines in FIG. 2. The futon 10 also includes a front cross member 18 and a rear cross member 20, both interconnecting between the side frames 16 and forming supports for the seat deck 12 and back deck 14, respectively, in the bed position while only the front cross piece 18 forms a support for the seat deck in the sofa position.

Figure 2:
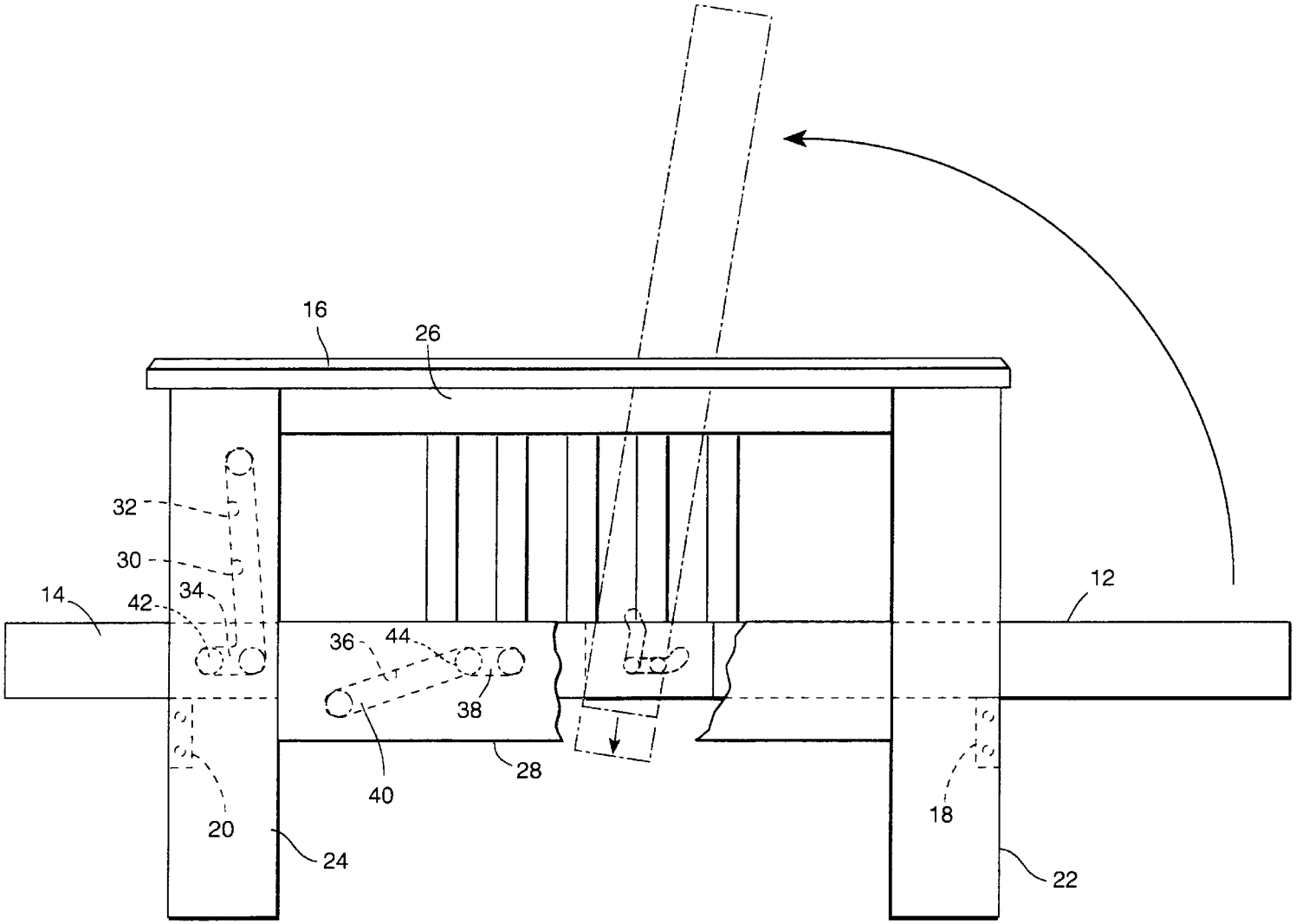
FIG. 2 is an enlarged side elevational view of the futon of FIG. 1 illustrating the seat deck in position at the beginning of its conversion from a bed position to a sofa position.

As illustrated in FIG. 2, each side frame member 16 includes front and rear vertically-extending supports 22 and 24, respectively, and upper and lower horizontally-extending supports 26 and 28, respectively, interconnecting the vertical supports 22 and 24. The rear vertical support 24 includes a groove 30 formed along its inside face. Each groove 30 has a generally vertically, slightly-rearwardly extending groove portion 32 and a short, generally horizontally-extending groove portion 34 forming a continuous groove in the support 24. Additionally, the lower horizontal support 28 includes a groove 36 having a short, generally horizontally-extending portion 38 and a rearwardly-extending, downwardly-inclined angled portion 40. The grooves 30 and 36 receive rollers 42 and 44, respectively, carried by the back deck 14 for guiding the movement of the back deck between the sofa and bed positions as described below.

Figure 3:
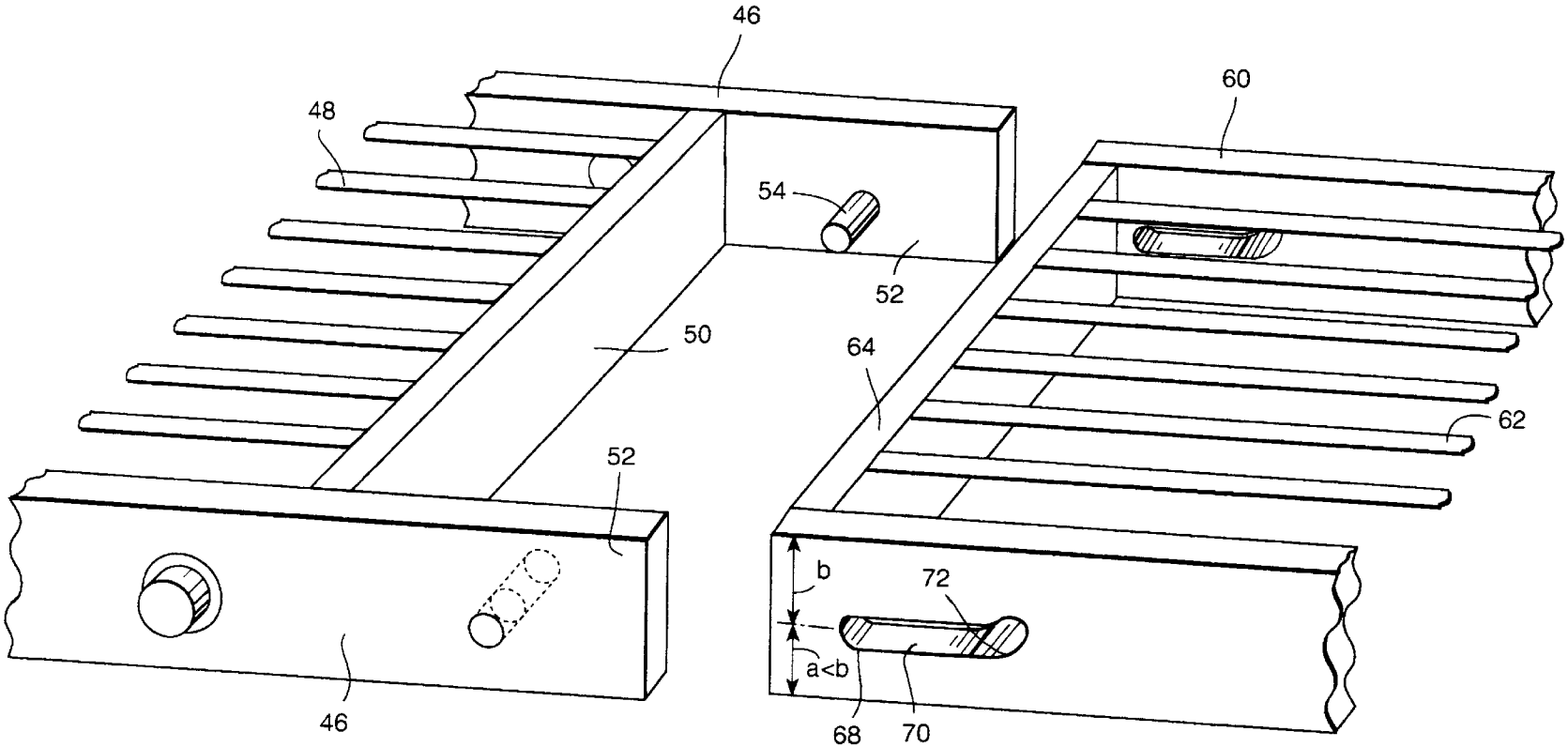
FIG. 3 is an enlarged fragmentary exploded perspective view illustrating the joint between the seat deck and back deck.

Referring to FIG. 3, the back deck 14 includes side frame members 46, a plurality of slats 48 generally parallel to the side frame members, and a back slat support 50 extending between the side frame members 46. The side frame members 46 also have extensions 52 which extend beyond the support 50 and carry posts or pins 54 which project inwardly of the side frame members 46 for cooperation with slots in the side frame members of the seat deck described below. The side frame members 46 also mount the pairs of rollers 42 and 44 receivable in the slots 30 and 36, respectively.

The seat deck 12 includes side frame members 60, a plurality of slats 62 and opposite end pieces joining the side frame members 60, one of which is illustrated at 64 in FIG. 3. The seat deck 12 has a width for disposition between the extensions 52 of the side frame members of the back deck. Additionally, the side frame members 60 of the seat deck include slots 68 for receiving the pins 54 along opposite sides of the extensions 52. In accordance with the present invention, the slots 68 comprise a generally elongated slot portion 70 extending generally parallel to the side frame members 60 and an angularly-offset portion 72, which is angled toward the upper edge of the said an Additionally, it will be appreciated from a review of FIG. 3 that the pins 54 and the slots 68 are not centered along the center lines of the side frame members. Rather, the pins and slots are offset to the underside of the back deck and seat deck, respectively. This provides additional material between the pins and slots on the one hand, and the upper edges of the extensions and side frame members of the back and seat decks, respectively. The offset location of the slots 68 and pins 54 is indicated by the distances a and b in FIG. 3 wherein distance a is less than distance b. The shortened slot portions 72 essentially comprise dog-leg sections of the slots 68 which preferably extend away from the centerline to increase leverage during conversion.

Figure 4A:
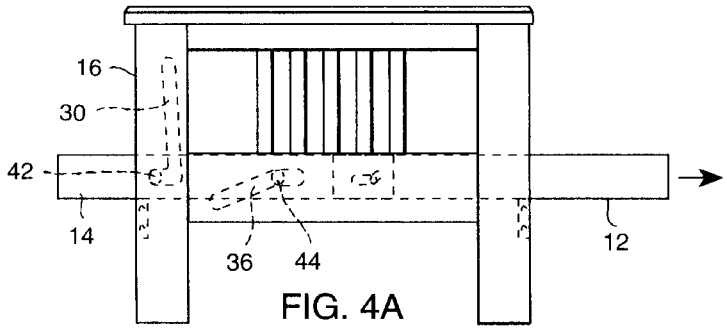
FIGS. 4A–4E are schematic illustrations of the manner of operation of the slot and post system hereof for converting the futon from the bed to the sofa position.
Figure 4B:
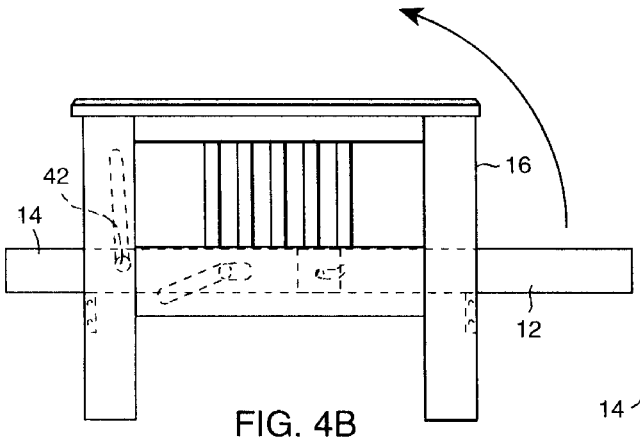
Figure 4C:
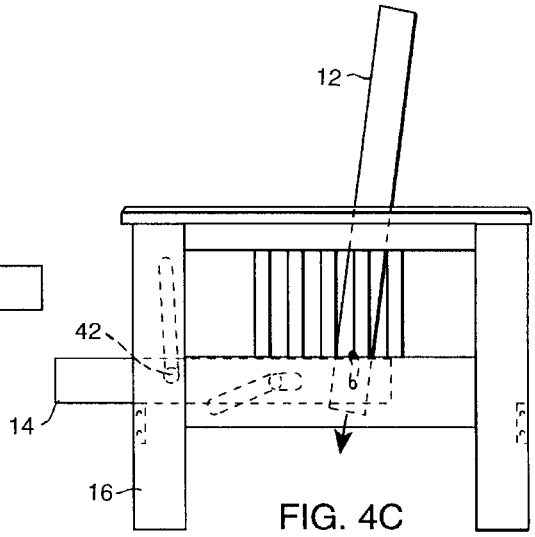
Figure 4D:
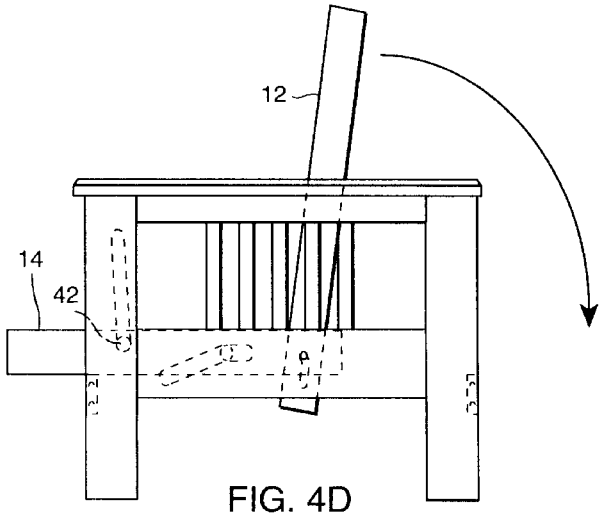
Figure 4E:
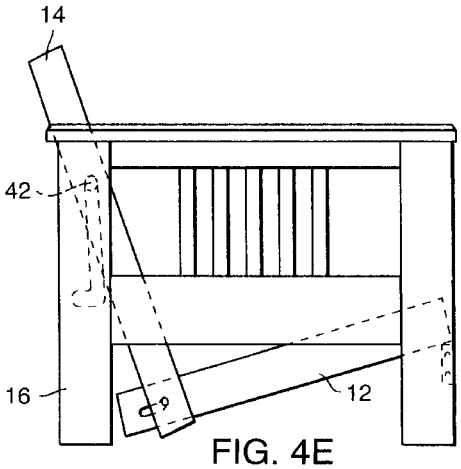

Referring now to FIGS. 4A–4E, the operation of the system will now be described. With the seat deck 12 and back deck 14 in the horizontal position as illustrated in FIGS. 2 and 4A, the rollers 42 lie rearmost in the slot portions 34. Rollers 44 lie adjacent the junctures of the horizontal and inclined portions of the slots 36. Further, the pins 54 engage the slots 68 substantially intermediate their ends and the ends of the side frame members 60 lie adjacent the slat support 50. To convert from the bed position to the sofa position, the seat deck 12 is displaced forwardly to locate the pins 54 in the rearmost portions of slot 68 whereupon further forward movement of the seat deck displaces the back deck 14 to locate the rollers 42 and 44 in the furthest forwardmost portions of the slot portions 34 and 38, respectively. Upon tilting seat deck 12 into the position illustrated by the dashed lines in FIG. 2 and in FIGS. 4B and 4C, the seat deck 12 is pivoted upwardly and is slidable downwardly relative to pins 54 (as illustrated by the arrow in FIG. 4C), thus locating the pins 54 in the extreme ends of the dog-leg slot portions 72. The downward movement of the seat deck with guiding movement of the slots along the pins displaces the seat deck away from the back deck ensuring a longer lever arm for leverage the back deck upwardly into its inclined sofa position upon downward pivoting movement of the seat deck. With the distance a less than distance b, a substantial portion of the wood of the side frame members is available to enable the increased leverage without splitting. Particularly, the side frame members 60 are located in position below the slat support 50 so that downward pivoting of the seat deck 12 from the position illustrated in FIGS. 2 and 4C leverages the back deck for movement from the horizontal bed position to the inclined sofa position. More particularly, by pivoting the seat deck in the reverse direction, the side frame members 60 engage slat support 50 (FIG. 4D) to displace rollers 42 upwardly along the vertical portions 32 of slots 30 and rollers 44 rearwardly and downwardly along the downwardly-inclined portions 40 of slots 36. Consequently, as the seat deck 12 is lowered, the back deck 14 is leveraged into the inclined position with the rollers 42 and 44 following the roller guides 30 and 36, respectively. When the rollers reach the extreme ends of the slot portions 30 and 36, the seat is lowered so that its front portion rests on the cross piece 18. The rear portion of the seat is supported by the pins 54 in the slots 68. When the dog-leg portions 72 extend to the opposite sides of the slots, the forward edge of the seat deck is at a higher location upon contact between the side frame members 60 and the a support 50 whereby the individual pivoting the seat deck downwardly has increased leverage.

To return the futon in the sofa position to the bed position, seat deck 12 is displaced forwardly to engage the pins in the rearmost portion of the slots 68. Upon further forward displacement of the seat, the back deck 14 is displaced into the horizontal position with the rollers 42 and 44 moving along the slots 30 and 36, respectively, to locate the rollers at the juncture of the slot portions. Rearward movement of the seat deck and back deck locks the back deck in position with the seat deck supported by cross piece 18 and from the back deck.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A futon comprising:

a pair of side frames spaced from one another with front and rear cross supports;

a seat deck and a back deck between said side frames and adjacent respective forward and rear portions of the futon, each said side frame having a first guide slot adjacent said rear portion of the futon forming generally vertically and horizontally extending guide portions, respectively, and a second slot forwardly of said rear portion having a generally horizontally extending guide portion and a guide portion extending therefrom in a downwardly inclined rearward direction;

said back deck having side frame members with rollers along each of the opposite sides thereof engaging in said first and second slots respectively enabling movement of said back deck between a first generally horizontal position and a second inclined position;

said back deck including forward extensions of said side frame members having pins directed toward one another, and a cross piece extending between said side frame members of said back deck and rearwardly of said pins;

said seat deck having a pair of side frame members with rear portions thereof extending between the forward extensions of said back deck side frame members and slots along said seat deck side frame members for receiving said pins, said slots having first rear slot portions extending generally parallel to said seat deck side frame members and terminating in front slot portions at ends thereof closest to the front seat deck portion, said front slot portions being offset and angled toward the upper edges of the side frame members;

said seat deck and said back deck being movable between a first position with the back deck and seat deck lying generally horizontally in a common plane resting on said front and rear supports, respectively, and a second position with said back deck inclined upwardly and rearwardly forming a seat back and said seat deck inclined upwardly and forwardly from said seat back forming a seat;

said seat deck and back deck being convertible between said positions by pivoting said seat deck in one direction about said pins to an upwardly-inclined position displacing the seat deck relative to said pins to locate the pins in the offset slot portions thereof, thereby locating ends of said seat deck side frame members below said cross piece to enable said back deck to be moved into said inclined position forming the seat back by pivoting the seat deck in a direction opposite said one direction with the side frame seat deck members leveraging the seat back into said inclined positions;

said pins and said slots in said seat deck lying off center from centerlines along the respective side frame members such that said pin and said slot along each side of the futon lie between the centerlines and a lower edge of said side frame member when the seat deck and the back deck lie in said first position.

2. A futon according to claim 1 wherein said offset front slot portions displace the seat deck away from the back deck when said seat deck is in said upwardly inclined position thereof to afford substantial leverage when pivoting the back deck into the inclined position to form the seat back.

* * * * *